United States Patent [19]

Riehl

[11] 4,179,261

[45] Dec. 18, 1979

[54] BURNER CONSTRUCTION AND PARTS THEREFOR AND METHODS OF MAKING THE SAME

[75] Inventor: Fred Riehl, Greensburg, Pa.

[73] Assignee: Robertshaw Controls Company, Richmond, Va.

[21] Appl. No.: 824,482

[22] Filed: Aug. 15, 1977

[51] Int. Cl.[2] ..... F23D 13/36

[52] U.S. Cl. ..... 431/286

[58] Field of Search ..... 431/286

[56] References Cited

U.S. PATENT DOCUMENTS

| | | | |
|---|---|---|---|
| 2,334,345 | 11/1943 | Mueller | 431/194 |
| 2,993,534 | 7/1961 | Greiner et al. | 431/286 |
| 3,092,169 | 6/1963 | Lohman | 431/286 |
| 3,694,133 | 9/1972 | Wilkerson | 431/286 |

*Primary Examiner*—Carroll B. Dority, Jr.

*Attorney, Agent, or Firm*—Candor, Candor & Tassone

[57] ABSTRACT

A burner construction having a plurality of burners disposed in a spaced arrangement thereof and each having ports for issuing fuel to be ignited, the construction having a plurality of ignition carry-over units respectively carried by the burners each being adapted to receive fuel from its respective burner and issue the same out of an ignition channel thereof that bridges part of the spacing between the burners adjacent thereto. Each carry-over unit has joint structure joining with the joint structure of an adjacent carry-over unit in such a manner that the joined joint structures cause the ignition channels thereof to be continuous between adjacent joined carry-over units. Each carry-over unit has opposed ends and the joint structure of each carry-over unit comprises a pair of tabs respectively disposed at the opposed ends thereof, the pair of tabs for each carry-over unit being disposed in planes offset relative to each other whereby adjacent tabs of adjacent carry-over units overlap each other in spaced relation to define part of the continuous ignition channel between adjacent carry-over units.

24 Claims, 12 Drawing Figures

BURNER CONSTRUCTION AND PARTS THEREFOR AND METHODS OF MAKING THE SAME

BACKGROUND OF THE INVENTION

1. Field of Search

This invention relates to an improved burner construction and to an improved ignition carry-over unit therefor as well as to methods for making such a burner construction and methods for making such an ignition carry-over unit.

2. Prior Art Statement

It is well known that burner constructions have been provided wherein each comprises a plurality of burners disposed in a spaced arrangement thereof and each has port means for issuing fuel to be ignited, the burner construction also having a plurality of ignition carry-over units respectively carried by the burners and each being adapted to receive fuel from its respective burner and issue the same out of an ignition slot means thereof that bridges part of the spacing between the burners adjacent thereto whereby merely the lighting of the fuel issuing from one part of one of the carry-over units will cause all of the carry-over units to provide complete ignition means for all of the burners of the burner construction.

For example, see the following U.S. Pat. Nos.:

(1) 3,694,133—Wilkerson (2) 3,092,169—Lohman (3) 2,993,534—Greiner et al.

The prior known carry-over units of item (1) above appear to depend on flash over of the ignition flame between adjacent carry-over units as there is no continuous ignition channel from carry-over unit to carry-over unit.

The prior known means of item (2) above appears to eliminate such flash over arrangement by providing a single piece carry-over structure that connects to a plurality of burners.

The prior known carry-over means of item (3) above appears to eliminate the flash over arrangement by having each carry-over unit be provided with a pair of tabs on one end thereof that telescopically receives an adjacent carry-over unit therein so that the ignition channels of the joined carry-over units are continuous between adjacent joined carry-over units.

SUMMARY OF THE INVENTION

Accordingly, it is a feature of this invention to provide multiple carry-over units for a multiple burner construction with the carry-over units being so constructed and arranged that the ignition channel means thereof is continuous between adjacent carry-over units so that flash over is not required to provide for ignition between adjacent carry-over units as in certain prior known multiple carry-over unit arrangements.

In particular, one embodiment of this invention provides a burner construction having a plurality of burners disposed in a spaced arrangement thereof each having port means for issuing fuel to be ignited, the burner construction having a plurality of ignition carry-over units respectively carried by the burners and each being adapted to receive fuel from its respective burner and issue the same out of an ignition slot means thereof that bridges part of the spacing between the burners adjacent thereto. Each carry-over unit has joining means joining with joining means of an adjacent carry-over unit in such a manner that the joined joining means causes the ignition slot means thereof to be continuous between each pair of adjacent carry-over units. Each carry-over unit has opposed ends and the joining means of each carry-over unit comprises a pair of tabs respectively disposed at the opposed ends thereof, the pair of tabs for each carry-over unit being disposed in planes offset relative to each other whereby adjacent tabs of adjacent carry-over units overlap each other in spaced relation to define part of the continuous slot means between adjacent carry-over units.

Accordingly, it is an object of this invention to provide an improved burner construction having one or more of the novel features of this invention as set forth above or hereinafter shown or described.

Another object of this invention is to provide a method of making such a burner construction, the method of this invention having one or more of the novel features of this invention as set forth above or hereinafter shown or described. Another object of this invention is to provide an improved ignition carry-over unit having one or more of the novel features of this invention as set forth above or hereinafter shown or described.

Another object of this invention is to provide an improved method of making such an ignition carry-over unit, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
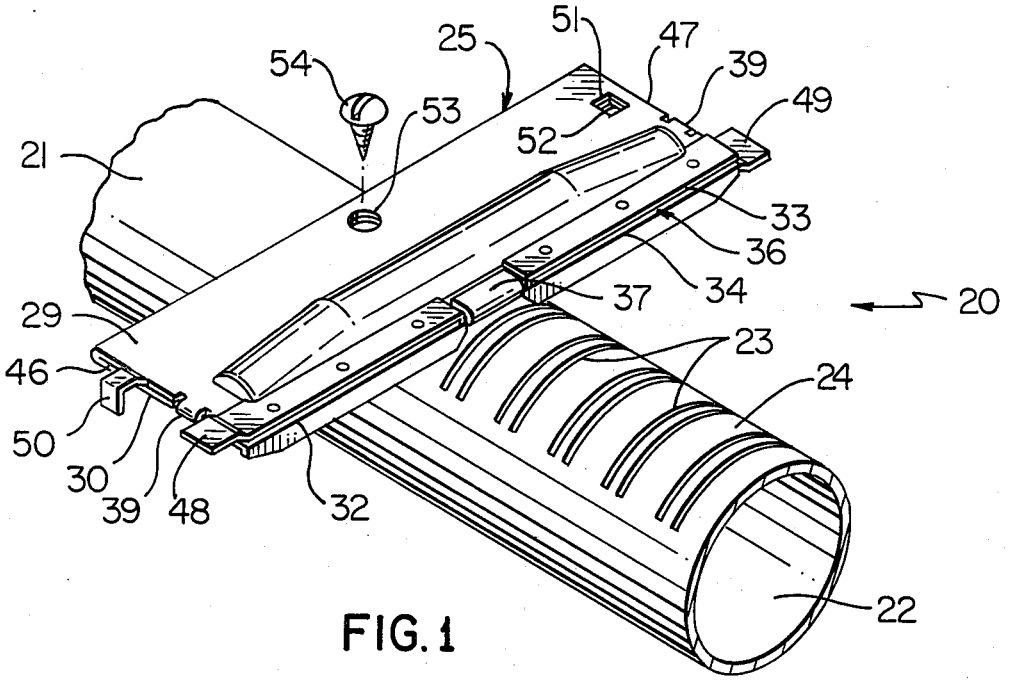
FIG. 1 is a perspective view of one burner and its associated ignition carry-over unit of this invention which assembly forms part of the burner construction of this invention that is illustrated in FIG. 2.

While the various features of this invention are hereinafter described and illustrated as being particularly adapted to provide an ignition carry-over means for tubular burners, it is to be understood that the various features of this invention can be utilized singly or in any combination thereof to provide ignition carry-over means for other types of burners as desired.

Therefore, this invention is not to be limited to only the embodiment illustrated in the drawings, because the drawings are merely utilized to illustrate one of the wide variety of uses of this invention.

Figure 2:
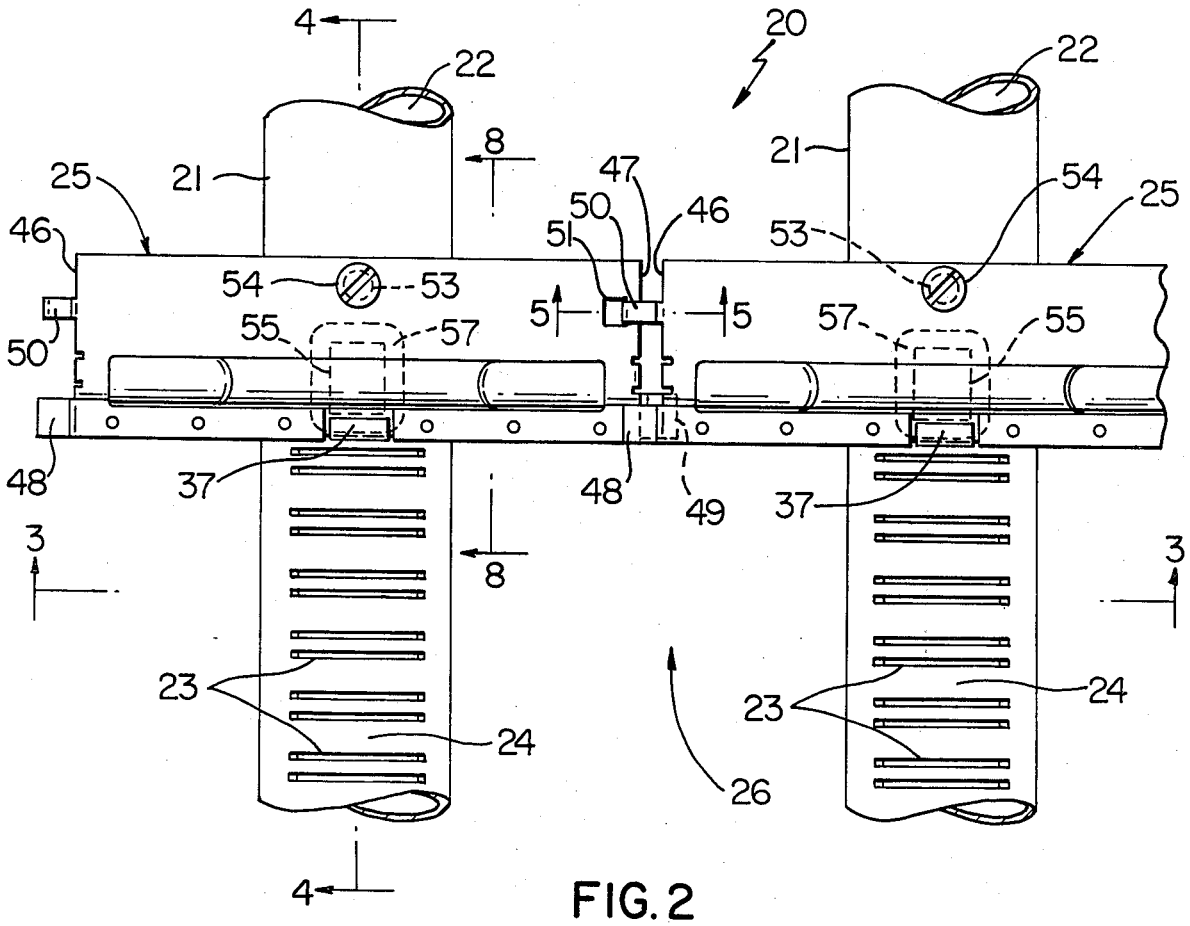
FIG. 2 is a fragmentary top view of the improved burner construction of this invention.

Referring now to FIGS. 1 and 2, the improved burner construction of this invention is generally indicated by the reference numeral 20 and comprises a plurality of tubular burners 21 disposed in spaced parallel relation and being supported by conventional frame structure (not shown) of a cooking apparatus, furnace or other heating device as desired in a manner well known in the art to receive fuel from a supply source (not shown) into the internal chambers 22 of the burners 21 to be issued out of suitable port means 23 formed in the top surface 24 of the burners 21 to be ignited and thereafter burn as long as fuel is being received in the chambers 22 thereof.

Each burner 21 carries an ignition carry-over unit of this invention that is generally indicated by the reference numeral 25 and each being formed in substantially an identical manner by a method of this invention as hereinafter set forth, the ignition carry-over units 25 being joined together in side-by-side relation as illustrated in FIG. 2 to complete the burner construction 20 of this invention so that adjacent ignition carry-over units 25 bridge the spacing 26 disposed between adjacent burners 21 as illustrated in FIG. 2 and provide a continuous ignition channel between the adjacent ignition carry-over units 25 in a manner hereinafter described.

Figure 8:
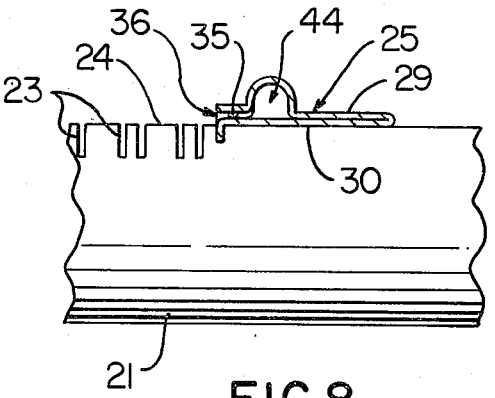
FIG. 8 is a fragmentary cross-sectional view taken on line 8—8 of FIG. 2.
Figure 9:
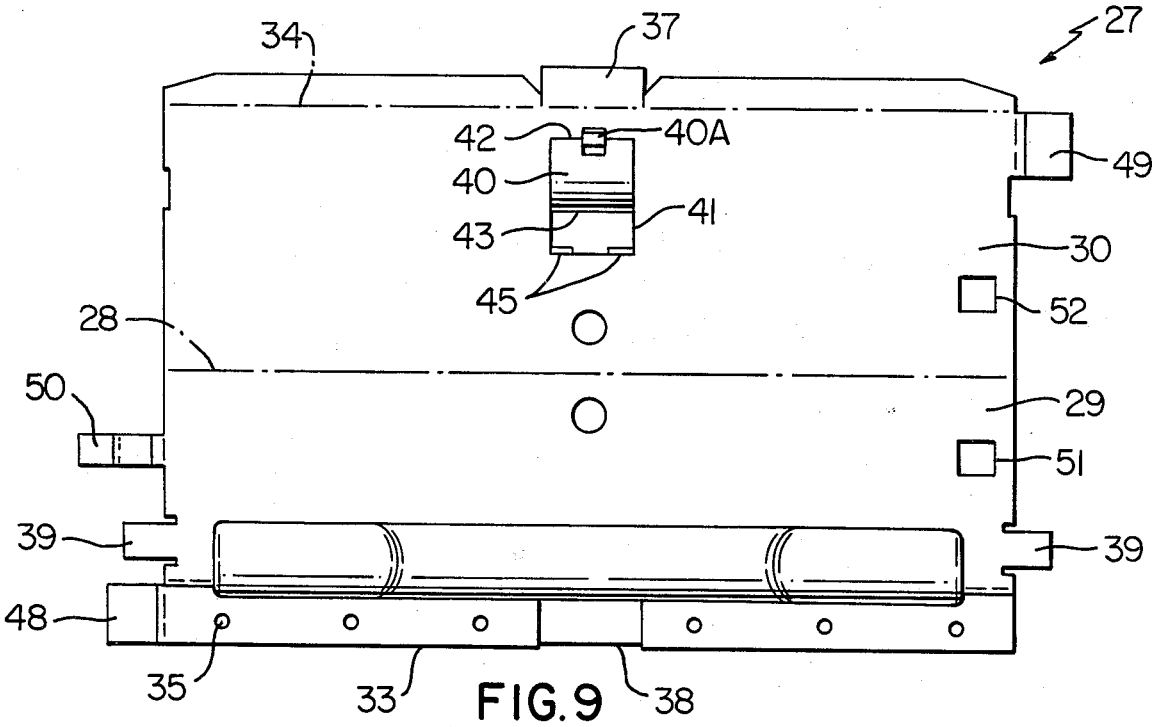
FIG. 9 is a plan view of a blank of material of this invention utilized to form one of the ignition carry-over units of this invention.
Figure 10:
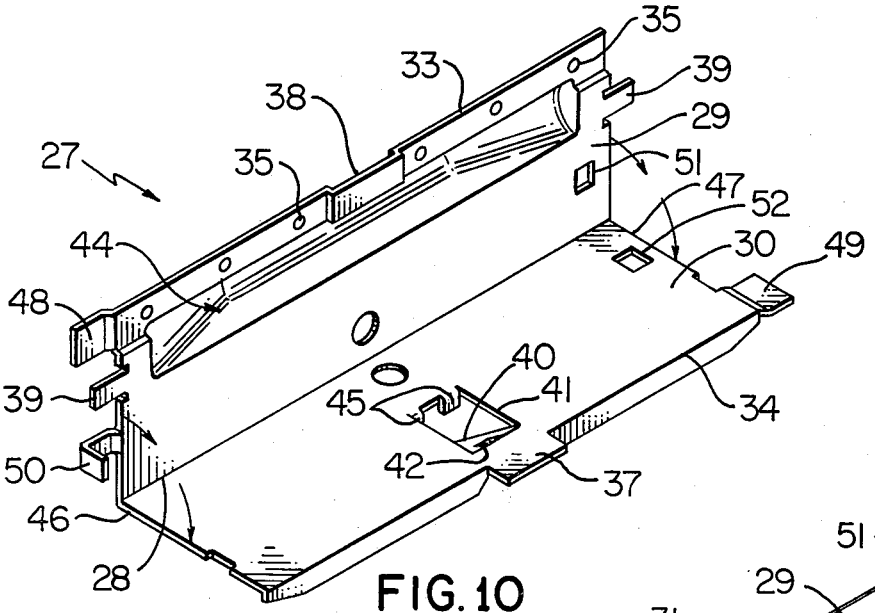
FIG. 10 is a perspective view illustrating a folding step in the method of this invention for making a carry-over unit of this invention from the blank of FIG. 9.
Figure 11:
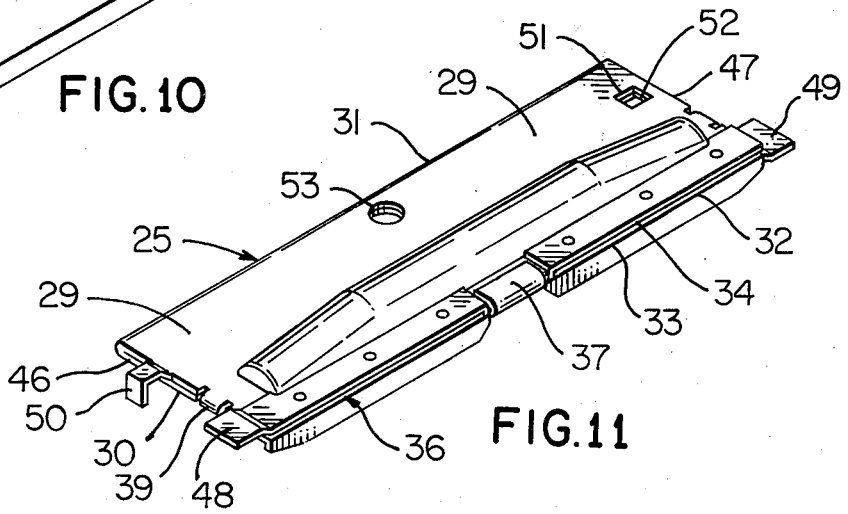
FIG. 11 is a perspective view of the completed carry-over unit made by the method of this invention from the blank of FIG. 9.

Each ignition carry-over unit 25 of this invention is formed from a blank of metallic material that is generally indicated by the reference numeral 27 in FIG. 9 and can be suitably cut and formed from a larger sheet into the configuration illustrated in FIG. 9 whereby the member 27 can be folded upon itself along a hinge line 28 illustrated by a dash-dot line in FIG. 9 in the manner illustrated in FIG. 10 to bring a top section 29 of the blank 27 in overlapping relation against a lower section 30 of the blank 27 as illustrated in FIG. 11. In this manner the resulting ignition carry-over unit 25 has a hinged edge 31 and an unhinged edge 32 defined by the resulting side edges 33 and 34 of the sections 29 and 30 being brought adjacent each other as illustrated in FIG. 11. However, the side edges 33 and 34 are held spaced from each other by suitable embossed abutments 35 being formed in the top section 29 to engage against the bottom section 30 and thereby provide an ignition slot means or channel means that is generally indicated by the reference numeral 36 in FIGS. 3 and 8 so that fuel can issue from between the top and bottom sections 29 and 30 in a manner hereinafter described out through the ignition slot means 36 to be ignited and provide carry-over flames between adjacent burners 21 in a manner hereinafter described.

Figure 7:
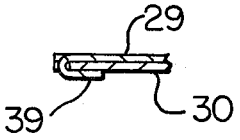
FIG. 7 is a fragmentary cross-sectional view taken on line 7—7 of FIG. 2.

In order to hold the folded sections 29 and 30 into the overlapping arrangement illustrated in FIG. 11, an integral tab 37 of the bottom section 30 of the blank 27 is adapted to be folded into the recessed area 38 of the top section 29 as illustrated in FIG. 11 to hold the top and bottom sections 29 and 30 in the assembled relation illustrated in FIG. 11. In addition, the top section 29 is provided with a pair of opposed interlocking tabs 39 which can be subsequently bent under the bottom section 30 to also hold the sections 29 and 30 together in the manner illustrated in FIGS. 7 and 11 whereby it can be seen that it is a relatively simple assembly operation of this invention to fold the blank 27 to form the completed carry-over unit 25 of this invention as illustrated in FIG. 11.

The blank 27 for each carry-over unit 25 has a rectangularly shaped scoop or tab 40 carved from the bottom section 30 thereof to define a rectangular opening 41 passing through the section 30, the scoop 40 being integrally hinged to the section 30 at the hinge line 42 with the free end 43 thereof being disposed at an angle relative to the section 30 as illustrated in the drawings so as to scoop fuel from its respective burner 21 in a manner hereinafter set forth and direct the scooped fuel through the opening 41 and into an embossed channel means 44 formed in the top section 29. The channel means 44 causes the scooped fuel to spread substantially completely along the entire length of the carry-over unit 25 to subsequently issue out of the interconnecting ignition slot means 36 thereof for a purpose hereinafter described.

During the forming of the opening 41 through the bottom section 30 of the carry-over unit 25, locating tabs 45 are also formed integrally with the bottom section 30 and are bent downwardly at a right angle relative thereto so as to project downwardly from the carry-over unit 25 to permit the carry-over unit 25 to be properly oriented relative to its respective burner 21 in a manner hereinafter set forth.

A locking tab 40A is also carved from the scoop 40 during the forming of the opening 41 through the bottom section 30 of the carry-over unit 25, the locking tab 40A being bent into the configuration illustrated in FIGS. 4 and 4A for a locking purpose with the respective burner 21 as will be apparent hereinafter.

The opposed end edges 46 and 47 of the top and bottom sections 29 and 30 of each blank 27 have respectively outwardly directed joining tabs 48 and 49 which are bent as illustrated so as to be offset relative to each other when the top and bottom sections 29 and 30 are folded together into the completed arrangement illustrated in FIG. 11 for a purpose hereinafter described.

Also, the side edge 46 of the top section 29 of each blank 27 is provided with a tab 50 which can be bent into the hooking arrangement illustrated in FIGS. 10 and 11 to hook into aligned openings 51 and 52 formed through the top and bottom sections 29 and 30 of an adjacent carry-over unit for a purpose hereinafter set forth.

Figure 4:
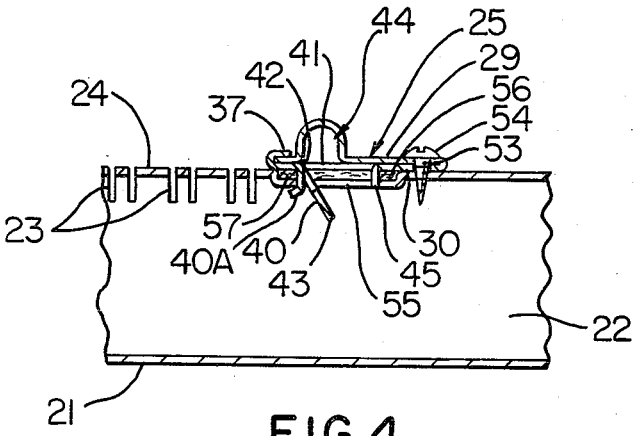
FIG. 4 is a fragmentary cross-sectional view taken on line 4—4 of FIG. 2.

While the completed carry-over units 25 of this invention can be secured to the burners 21 in any suitable manner, such as by welding or the like, the carry-over units 25 of this invention as illustrated in the drawings are provided with openings 53 passing completely therethrough to receive threaded fastening members 54, FIGS. 1 and 2, to fasten the respective carry-over unit 25 to the respective burner 21 as illustrated in FIG. 4.

Each burner 21 has a portion of the top surface 24 thereof flattened and provided with a rectangular opening 55 therethrough to receive the scoop tab 40 of the respective carry-over unit 25 in the manner illustrated in FIG. 4, the flattened portion of the top surface 24 of the respective burner 21 also being provided with an annular recess 56 surrounding the opening 55 and receiving a sealing gasket means 57 that will seal the top surface 24 of the respective burner 21 to the undersurface of the section 30 of the respective carry-over unit 25 when the same has been fastened thereto by the fastening means 54 in the manner illustrated in FIG. 4. In this manner, the aligned openings 41 and 55 of the carry-over unit 25 and burner 21 are substantially fluid sealed in communication with each other by the sealing gasket means 57 as illustrated.

Figure 6:
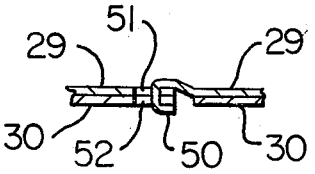
FIG. 6 is a view similar to FIG. 5 and illustrates the interlocking tab of FIG. 5 in a further bent condition thereof.
Figure 5:
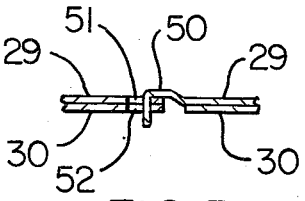
FIG. 5 is a fragmentary cross-sectional view taken on line 5—5 of FIG. 2.
Figure 4A:
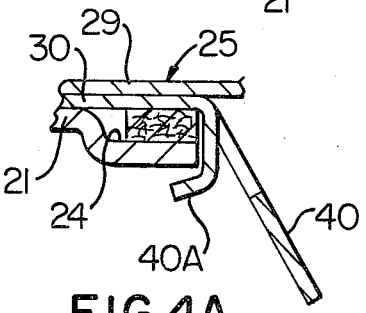
FIG. 4A is an enlarged fragmentary view of part of the structure illustrated in FIG. 4.

When the respective carry-over unit 25 is being assembled to its burner 21 in the manner illustrated in FIG. 4, it can be seen that the locking tab 40A is first inserted into the opening 55 of the burner 21 and then the carry-over unit is pushed to the left in FIGS. 4 and 4A to cause the locking tab 40A to hook and thereby lock under the flattened top surface 24 of the burner 21. Thereafter, the carry-over unit is further assembled to the burner by fully aligning the scoop 40 within one end of the opening 55 of the burner 21 while the locating tabs 45 align with the other side of the opening 55 so that the rotational position of the carry-over unit 25 is predetermined so as to be substantially transverse to the burner 21 when assembled thereto. In this manner, the carry-over units 25 will be oriented in the aligned relation illustrated in FIG. 2 so that the hooking tab 50 of one carry-over unit 25 can be received in the aligned openings 51 and 52 of the next adjacent carry-over unit 25 in the manner illustrated in FIGS. 2 and 5. If desired, the hooking tab 50 could be further bent under the next adjacent carry-over unit 25 from the position illustrated in FIG. 5 to the position illustrated in FIG. 6 to further lock adjacent carry-over units 25 together if desired.

Figure 3:
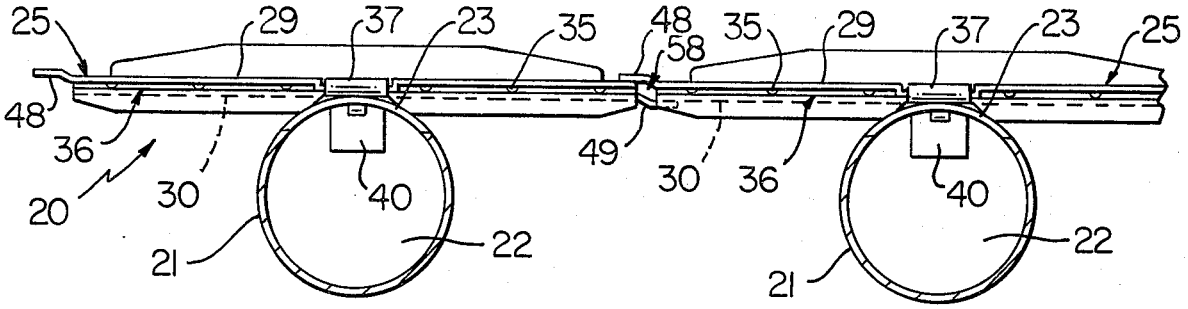
FIG. 3 is a fragmentary cross-sectional view taken on line 3—3 of FIG. 2.

In any event, it can be seen that when the carry-over units 25 are being serially assembled in the aligned relation illustrated in FIGS. 2 and 3, the upper joining tab 48 of one of the units 25 overlaps with the lower tab 49 of the adjacent carry-over unit 25 in the manner illustrated in FIG. 3 to define a channel spacing 58 therebetween that is in fluid communication with the ignition slot means 36 of the adjacent carry-over units 25 so that fuel can issue in a continuous manner from one burner 21 to the next adjacent burner 21 through the interconnecting channel means 36 and spacing 58 as illustrated in FIG. 3 to provide continuous flame therebetween. In this manner no flash over is required between adjacent carry-over units 25 as is provided by prior known multiple carry-over unit arrangements.

Therefore, it can be seen that it is a relatively simple method of this invention to form the burner construction 20 by merely fastening each carry-over unit 25 to its respective burner 21 through the positive orientation of the scooping tab 40 and locating tabs 45 in the rectangular opening 55 of the respective burner 21 and causing the upper tab 48 thereof to overlap and engage against the top surface of the previously assembled and adjacent carry-over unit 25 in the manner illustrated in FIG. 3 while the lower tab 49 of the previously assembly and adjacent carry-over unit 25 engages and overlaps against the bottom of the carry-over unit 25 as illustrated in FIG. 3 to define the continuous channel portion 58 between the ignition slot means 36 of the adjacent units 25. During such assembly operation, the hooking tab 50 of the carry-over unit 25 is received in the aligned openings 51 and 52 of the previously assembled and adjacent carry-over unit 25 to either remain in the hooked position illustrated in FIG. 5 or the further locked position illustrated in FIG. 6, as desired.

Once the carry-over unit 25 has been assembled in the above manner, the same can be fastened to its respective burner 21 by the threaded fastening member 54 as illustrated whereby the hook 40A of the respective carry-over unit 25 is held in its locking position as illustrated in FIGS. 4 and 4A.

In this manner, the carry-over units 25 can be assembled to the burners 21 from left to right in a serial manner as illustrated in FIG. 2 until all of the carry-over units 25 have been assembled in place.

Thereafter, the thus completed burner construction 20 can operate in a manner now to be described.

When it is desired to initially ignite the burner construction 20, fuel is directed into the chambers 22 of the burners thereof and it can be seen that the same will flow from the top of the burners 21 in FIG. 2 downwardly toward the ports 23 thereof and the scoops 40 of the carry-over units 25 will scoop the fuel flowing from right to left in FIG. 4 up through the openings 41 of the respective carry-over units 25 to be diffused along the channel means 44 throughout the lengths of the carry-over units 25 to thereafter issue in substantially a continuous manner out through the ignition slot means 36 thereof as well as from the channels 58 between the adjoining tabs 48 and 49 of the adjacent units 25.

Therefore, merely igniting the fuel issuing from part of one slot means 36 of one carry-over unit 25 will cause that ignition flame to pass completely along the entire continuous slot means 36 of that ignition carry-over unit 25 and its next adjacent carry-over unit 25 throughout the entire space 26 between their adjacent burners 21 to thereby ignite the fuel issuing from the ports 23 of the adjacent burners 21. The fuel now issuing and burning from the ports 23 of the first two ignited burners 21 bridges the gaps in the ignition slots 36 caused by the locking tabs 37 of the respective carry-over units 25 so that the other half of the slots 36 thereof will be ignited by the ignited fuel from the burners 21 whereby a propagation of the ignition flames will continue both to the left and to the right of the initial ignition area of the carry-over units 25 until all of the burners 21 have been ignited.

In this manner, it can be seen that the ignition carry-over units 25 of this invention will provide a continuous ignition flame in the spacings 26 between adjacent burners 21 in a manner not provided by the prior known multiple carry-over arrangements.

Also, it can be seen that with the carry-over units 25 of this invention, should one of the burners 21 of the completed burner construction 20 need replacing, that burner 21 and its carry-over unit 25 can be readily disassembled from the burner construction 20 by merely bending the tab means 50 out of the way and lifting the damaged burner 21 and its carry-over unit 25 from the assembly so that a new burner 21 and carry-over unit 25 can be substituted in its place.

In this manner, all of the burners 21 need not be removed for a replacement operation as is required when a single piece carry-over unit is provided for all of the burners 21 as in the previously described prior known arrangement.

Therefore, it can be seen that this invention not only provides an improved burner construction and method of making the same, but also this invention provides an improved ignition carry-over unit and method of making the same.

While the forms and methods of this invention now preferred have been illustrated and described as required by the Patent Statue, it is to be understood that other forms and method steps can be utilized and still all within the scope of the appended claims.

What is claimed is:

1. In a burner construction having a plurality of burners disposed in a spaced arrangement thereof and each having port means for issuing fuel to be ignited, said construction having a plurality of ignition carry-over units respectively carried by said burners and each being adapted to receive fuel from its respective burner and issue the same out of an ignition slot means thereof that bridges part of the spacing between said burners adjacent thereto, each said carry-over unit having joining mens joining with said joining means of an adjacent carry-over unit in such a manner that said joined joining means causes said ignition slot means thereof to be continuous between adjacent joined carry-over units, each said carry-over unit having opposed ends, the improvement wherein said joining means of each said carry-over unit comprises a pair of tabs respectively disposed at said opposed ends thereof, said pair of tabs for each said carry-over unit being disposed in planes offset relative to each other whereby adjacent tabs of adjacent carry-over units overlap each other in spaced relation to define part of said continuous slot means between said adjacent carry-over units, each said carry-over unit having hook means hooking to its respective burner to tend to hold the same together in their assembled relation.

2. In a burner construction having a plurality of burners disposed in a spaced arrangement thereof and each having port means for issuing fuel to be ignited, said construction having a plurality of ignition carry-over units respectively carried by said burners and each being adapted to receive fuel from its respective burner and issue the same out of an ignition slot means thereof that bridges part of the spacing between said burners adjacent thereto, each said carry-over unit having joining means joining with said joining means of an adjacent carry-over unit in such a manner that said joined joining means causes said ignition slot means thereof to be continuous between adjacent joined carry-over units, each said carry-over unit comprising a one-piece member folded upon itself to define a hinged end thereof and an unhinged end thereof, said unhinged end of each said carry-over unit defining said slot means thereof, said folded member of each said carry-over unit defining two sections folded adjacent each other, the improvement wherein said sections of each said carry-over unit have tab means folded to secure said sections in said folded relation thereof.

3. A burner construction as set forth in claim 2 wherein each said carry-over unit has one of said sections thereof provided with an opening therethrough for receiving fuel from its respective burner to issue between said sections and out of said slot means thereof.

4. A burner construction as set forth in claim 3 wherein each said carry-over unit has said one section thereof provided with a scoop carved therefrom during the forming of said opening thereof to project into the respective burner to scoop fuel therefrom into said opening of said one section.

5. A burner construction as set forth in claim 4 wherein each said carry-over unit has said one section thereof provided with locating tabs adjacent said opening thereof for orienting said carry-over unit relative to its respective burner.

6. A burner construction as set forth in claim 4 wherein said scoop of each said carry-over unit has hook means carved therefrom and hooking to its respective burner to tend to hold the same together in their assembled relation.

7. In an ignition carry-over unit for a burner construction having a plurality of burners disposed in a spaced arrangement thereof and having a plurality of said ignition carry-over units respectively carried by said burners and each being adapted to receive fuel from its respective burner and issue the same out of an ignition slot means thereof that bridges part of the spacing between said burners adjacent thereto, said carry-over unit having joining means for joining with said joining means of an adjacent carry-over unit in such a manner that said joined joining means is adapted to cause said ignition slot means thereof to be continuous between adjacent joined carry-over units, said carry-over unit having opposed ends, the improvement wherein said joining means of said carry-over unit comprises a pair of tabs respectively disposed at said opposed ends thereof, said pair of tabs for said carry-over unit being disposed in planes offset relative to each other whereby adjacent tabs of adjacent carry-over units are adapted to overlap each other in spaced relation to define part of said continuous slot means between said adjacent carry-over units, said carry-over unit having hook means adapted to hook to its respective burner to tend to hold the same together in their assembled relation.

8. In an ignition carry-over unit for a burner construction having a plurality of burners disposed in a spaced arrangement thereof and having a plurality of said ignition carry-over units respectively carried by said burners and each being adapted to receive fuel from its respective burner and issue the same out of an ignition slot means thereof that bridges part of the spacing between said burners adjacent thereto, said carry-over unit having joining means for joining with said joining means of an adjacent carry-over unit in such a manner that said joined joining means is adapted to cause said ignition slot means thereof to be continuous between adjacent joined carry-over units, said carry-over unit comprising a one-piece member folded upon itself to define a hinged end thereof and an unhinged end thereof, said unhinged end of said carry-over unit defining said slot means thereof, said folded member of said carry-over unit defining two sections folded adjacent each other, the improvement wherein said sections of said carry-over unit have tab means folded to secure said sections in said folded relation thereof.

9. A carry-over unit as set forth in claim 8 wherein said carry-over unit has one of said sections thereof provided with an opening therethrough adapted for receiving fuel from its respective burner to issue between said sections and out of said slot means thereof.

10. A carry-over unit as set forth in claim 9 wherein said carry-over unit has said one section thereof provided with a scoop carved therefrom during the forming of said opening thereof and adapted to project into the respective burner to scoop fuel therefrom into said opening of said one section.

11. A carry-over unit as set forth in claim 10 wherein said carry-over unit has said one section thereof provided with locating tabs adjacent said opening thereof and adapted for orienting said carry-over unit relative to its respective burner.

12. A carry-over unit as set forth in claim 10 wherein said scoop of said carry-over unit has hook means carved therefrom adapted to hook to its respective burner to tend to hold the same together in their assembled relation.

13. In a method of making a burner construction having a plurality of burners disposed in a spaced arrangement thereof and each having port means for issuing fuel to be ignited, said construction having a plurality of ignition carry-over units respectively carried by said burners and each being adapted to receive fuel from its respective burner and issue the same out of an ignition slot means thereof that bridges part of the spacing between said burners adjacent thereto, each said carry-over unit having joining means joining with said joining means of an adjacent carry-over unit in such a manner that said joined joining means causes said ignition slot means thereof to be continuous between adjacent joined carry-over units, each said carry-over unit having opposed ends, the improvement comprising the steps of forming said joining means of each said carry-over unit to comprise a pair of tabs respectively disposed at said opposed ends thereof, forming said pair of tabs for each said carry-over unit to be disposed in planes offset relative to each other whereby adjacent tabs of adjacent carry-over units overlap each other in spaced relation to define part of said continuous slot means between said adjacent carry-over units, forming each said carry-over unit with hook means, and hooking said hook means of each said carry-over unit to its respective burner to tend to hold the same together in their assembled relation.

14. In a method of making a burner construction having a plurality of burners disposed in a spaced arrangement thereof and each having port means for issuing fuel to be ignited, said construction having a plurality of ignition carry-over units respectively carried by said burners and each being adapted to receive fuel from its respective burner and issue the same out of an ignition slot means thereof that bridges part of the spacing between said burners adjacent thereto, each said carry-over unit having joining means joining with said joining means of an adjacent carry-over unit in such a manner that said joined joining means causes said ignition slot means thereof to be continuous between adjacent joined carry-over units, each said carry-over unit comprising a one-piece member folded upon itself to define a hinged end thereof and an unhinged end thereof so that said unhinged end defines said slot means thereof, said folded member of each said carry-over unit defining two sections folded adjacent each other, the improvement comprising the steps of forming said sections of each said carry-over unit with tab means, and folding said tab means of each said carry-over unit to secure said sections thereof in said folded relation thereof.

15. A method of making a burner construction as set forth in claim 14 and including the step of forming one section of each said carry-over unit with an opening therethrough for receiving fuel from its respective burner to issue between said sections and out of said slot means thereof.

16. A method of making a burner construction as set forth in claim 15 and including the step of carving a scoop from said one section of each said carry-over unit during the forming of said opening thereof so as to project into the respective burner to scoop fuel therefrom into said opening of said one section.

17. A method of making a burner construction as set forth in claim 16 and including the step of forming said one section of each said carry-over unit with locating tabs adjacent said opening thereof for orienting said carry-over unit relative to its respective burner.

18. A method of making a burner construction as set forth in claim 16 and including the steps of carving hook means from said scoop of each said carry-over unit, and hooking said hook means of each said carry-over unit to its respective burner to tend to hold the same together in their assembled relation.

19. In a method of making an ignition carry-over unit for a burner construction having a plurality of burners disposed in a spaced arrangement thereof and having a plurality of said ignition carry-over units respectively carried by said burners and each being adapted to receive fuel from its respective burner and issue the same out of an ignition slot means thereof that bridges part of the spacing between said burners adjacent thereto, said carry-over unit having joining means adapted to join with said joining means of an adjacent carry-over unit in such a manner that said joined joining means is adapted to cause said ignition slot means thereof to be continuous between adjacent joined carry-over units, said carry-over unit having opposed ends, the improvement comprising the steps of forming said joining means of said carry-over unit to comprise a pair of tabs respectively disposed at said opposed ends thereof, forming said pair of tabs for said carry-over unit to be disposed in planes offset relative to each other whereby adjacent tabs of adjacent carry-over units are adapted to overlap each other in spaced relation to define part of said continuous slot means between said adjacent carry-over units, and forming said carry-over unit with hook means for hooking to its respective burner to tend to hold the same together in their assembled relation.

20. In a method of making an ignition carry-over unit for a burner construction having a plurality of burners disposed in a spaced arrangement thereof and having a plurality of said ignition carry-over units respectively carried by said burners and each being adapted to receive fuel from its respective burner and issue the same out of an ignition slot means thereof that bridges part of the spacing between said burners adjacent thereto, said carry-over unit having joining means adapted to join with said joining means of an adjacent carry-over unit in such a manner that said joined joining means is adapted to cause said ignition slot means thereof to be continuous between adjacent joined carry-over units, said carry-over unit comprising a one-piece member folded upon itself to define a hinged end thereof and an unhinged end thereof so that said unhinged end defines said slot means thereof, said folded member of said carry-over unit defining two sections folded adjacent each other, the improvement comprising the steps of forming said sections of said carry-over unit with tab means, and folding said tab means of said carry-over unit to secure said sections thereof in said folded relation thereof.

21. A method of making a carry-over unit as set forth in claim 20 and including the step of forming one section of said carry-over unit with an opening therethrough adapted for receiving fuel from its respective burner to issue between said sections and out of said slot means thereof.

22. A method of making a carry-over unit as set forth in claim 21 and including the step of carving a scoop from said one section of said carry-over unit during the forming of said opening thereof so as to be adapted to project into the respective burner to scoop fuel therefrom into said opening of said one section.

23. A method of making a carry-over unit as set forth in claim 22 and including the step of forming said one section of said carry-over unit with locating tabs adjacent said opening thereof so as to be adapted to orient said carry-over unit relative to its respective burner.

24. A method of making a carry-over unit as set forth in claim 22 and including the step of carving hook means from said scoop of said carry-over unit for hooking to its respective burner to tend to hold the same together in their assembled relation.

* * * * *